US007744479B2

(12) United States Patent
Whitfield

(10) Patent No.: US 7,744,479 B2
(45) Date of Patent: Jun. 29, 2010

(54) GOLF PRACTICE GAME APPARATUS WITH SENSORS

(76) Inventor: Richard A. Whitfield, 7407 SE. Hill Ter., Hobe Sound, FL (US) 33455

( * ) Notice: Subject to any disclaimer, the term of this patent is extended or adjusted under 35 U.S.C. 154(b) by 1146 days.

(21) Appl. No.: 11/328,986

(22) Filed: Jan. 10, 2006

(65) Prior Publication Data

US 2007/0167205 A1 Jul. 19, 2007

(51) Int. Cl.
*A63B 67/02* (2006.01)

(52) U.S. Cl. ..... 473/152; 473/150; 473/151; 473/153; 473/173; 473/174; 473/175; 473/176; 473/177; 473/178; 473/180; 473/185; 473/186; 473/190; 473/195; 473/196; 473/278; 473/279

(58) Field of Classification Search ..... 273/108.2, 273/108.21, 127 B, 127 R, 348, 371; 473/150–153, 473/171, 173–178, 180, 185–186, 190, 195–196, 473/278–279; 434/252
See application file for complete search history.

(56) References Cited

U.S. PATENT DOCUMENTS 1,678,573 A * 7/1928 Nakashima ..... 273/123 A
1,719,240 A 7/1929 Scanlan
1,784,068 A * 12/1930 Johnson ..... 473/17
2,626,152 A * 1/1953 Miller ..... 473/185
3,114,554 A * 12/1963 Hurley ..... 473/153
3,558,140 A 1/1971 Romeo
3,986,718 A * 10/1976 Long et al. ..... 473/153
4,002,339 A * 1/1977 Reiner et al. ..... 273/123 A
4,215,865 A * 8/1980 Pilati ..... 473/153
5,042,813 A 8/1991 Huang
5,087,045 A * 2/1992 Kim ..... 473/152
5,301,947 A * 4/1994 Kim ..... 473/153
5,803,451 A * 9/1998 Kelly et al. ..... 273/118 R
5,860,648 A * 1/1999 Petermeier et al. ..... 273/108.2
5,984,793 A 11/1999 Palombi
7,566,275 B2 * 7/2009 Yun ..... 473/152

* cited by examiner

*Primary Examiner*—Peter DungBa Vo
*Assistant Examiner*—David Duffy
(74) *Attorney, Agent, or Firm*—McHale & Slavin, P.A.

(57) ABSTRACT

A portable golf practice game consisting of a wall having a front face, rear face, and base. The wall includes a plurality of openings along the base for the entry of an object there-through. Each opening includes an opening sensor to detect the presence of an object there-through. The wall further includes proximity sensors along the base to detect the presence of an object not passing though an opening. The sensors emit a signal which is detected by a processor connected to the wall. Each opening has a corresponding graphic element which displays a value interpreted by the processor. A user chooses a game on the input device, then propels an object toward the wall, a sensor emits a signal, the processor interprets the signal and the graphic element displays an assigned value.

4 Claims, 4 Drawing Sheets

GOLF PRACTICE GAME APPARATUS WITH SENSORS

FIELD OF THE INVENTION

The present invention relates generally to games and, in particular, to a novel game apparatus that allows one or more players to use the game apparatus to accurately propel a ball (for example, a golf ball is putted) to achieve a score or value which can be used to play a game of strategy and/or chance, such as a card game.

BACKGROUND OF THE INVENTION

Other games are known in the art that include, as an element, putting a golf ball or otherwise propelling a ball. However, these games lack creativity and variability, with the function of the game limited and, as a result, a player of the game may quickly lose interest.

SUMMARY OF THE INVENTION

The novel game apparatus that is the subject of this invention is distinguished from games known in the art, and offers a significant and useful improvement over such games because, among other benefits and improvements, it permits one or more players to use a single apparatus for multiple games and further permits the combination of skill development and/or maintenance (such as putting a golf ball) with play of a game of strategy and/or chance, thereby making the skill development and maintenance more entertaining.

This novel game apparatus can be used by a player to play a game of skill in which a ball, such as a golf ball, is propelled toward one or more openings in the game apparatus, for example, with a putter. Game graphics associated with the openings are assigned values. For example, values associated with game graphics may be based upon one or more pre-existing games of chance and/or strategy, such as card games. Thus, in playing a game using the game apparatus that is the subject of this invention, a player can develop and maintain skills, such as putting a golf ball, while simultaneously using those skills to play another game, thereby making the skill development and maintenance more entertaining. Furthermore, the novel design of the game apparatus permits a variety of game graphics to be associated with openings in the game apparatus, thereby permitting play of a variety of games and increasing enjoyment and usefulness of the game apparatus.

BRIEF DESCRIPTION OF THE FIGURES

These and other features, aspects and advantages of the invention will become more fully apparent from the following detailed description, appended claims, and accompanying drawings, wherein the drawings illustrate certain features of the game apparatus in accordance with exemplary embodiments of the present invention, and wherein:

DETAILED DESCRIPTION OF THE INVENTION

Figure 1:
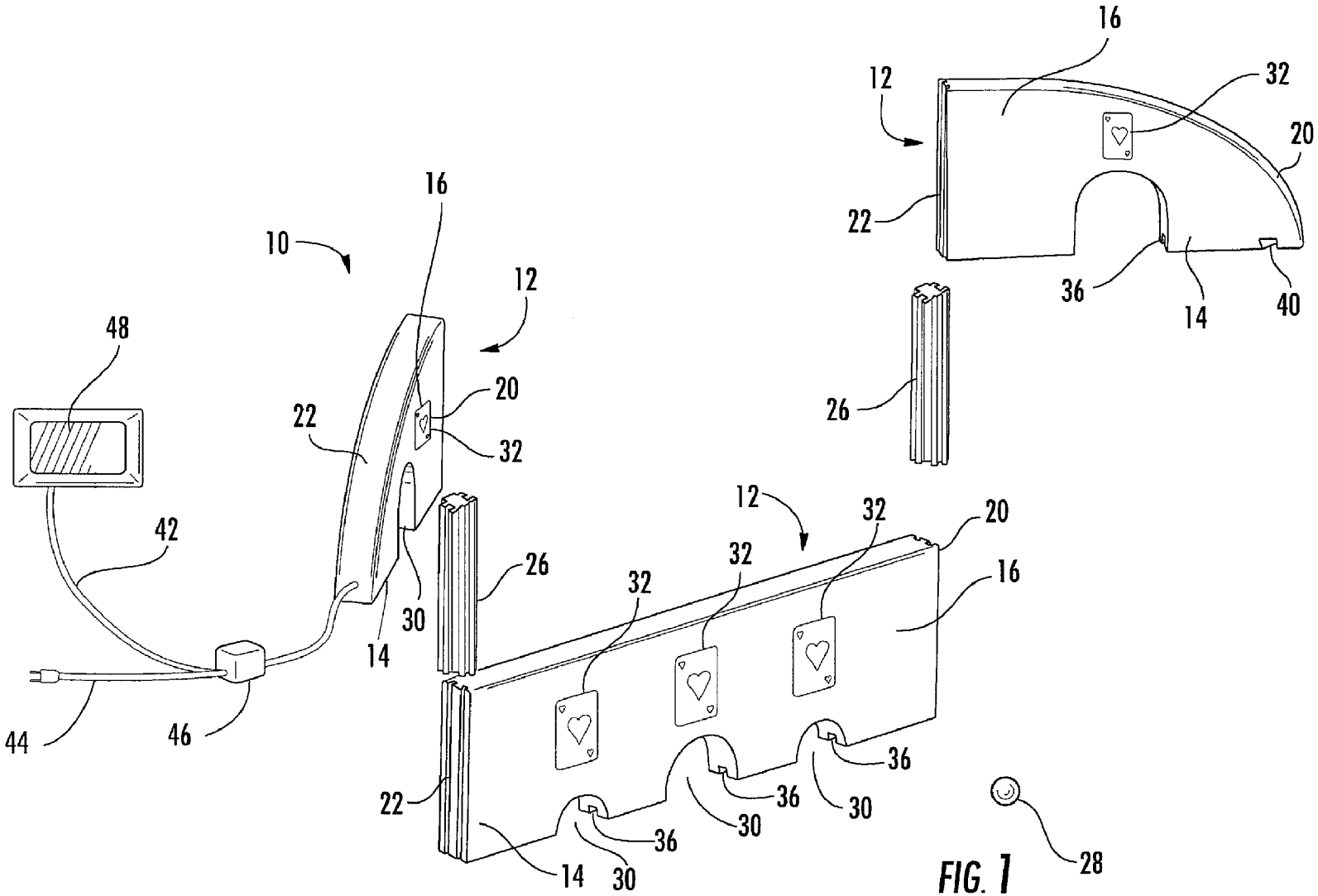
FIG. 1 is an illustration of the front of a preferred embodiment of the game apparatus.
Figure 2:
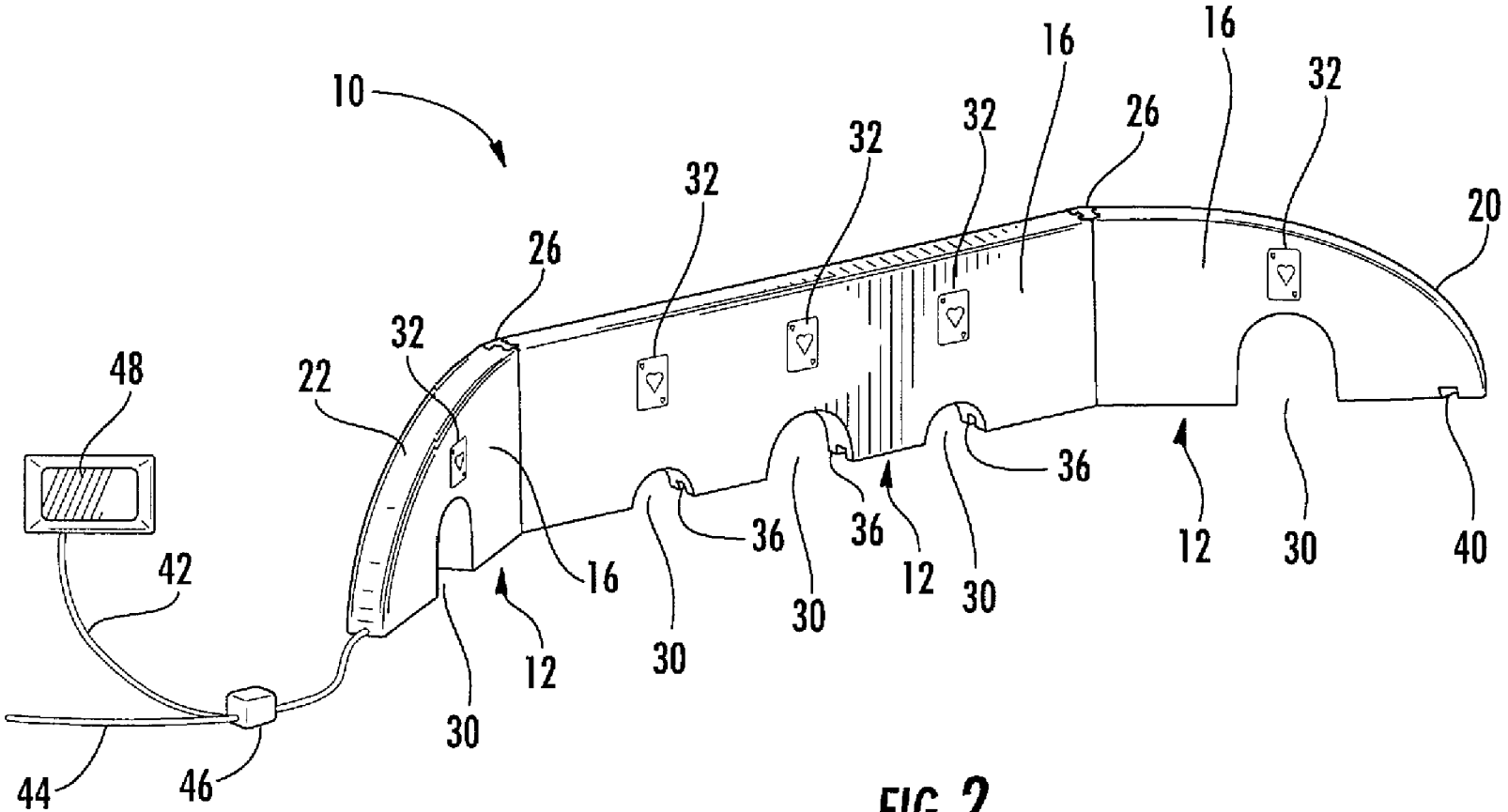
FIG. 2 is a front view of a preferred embodiment of the game apparatus.
Figure 3:
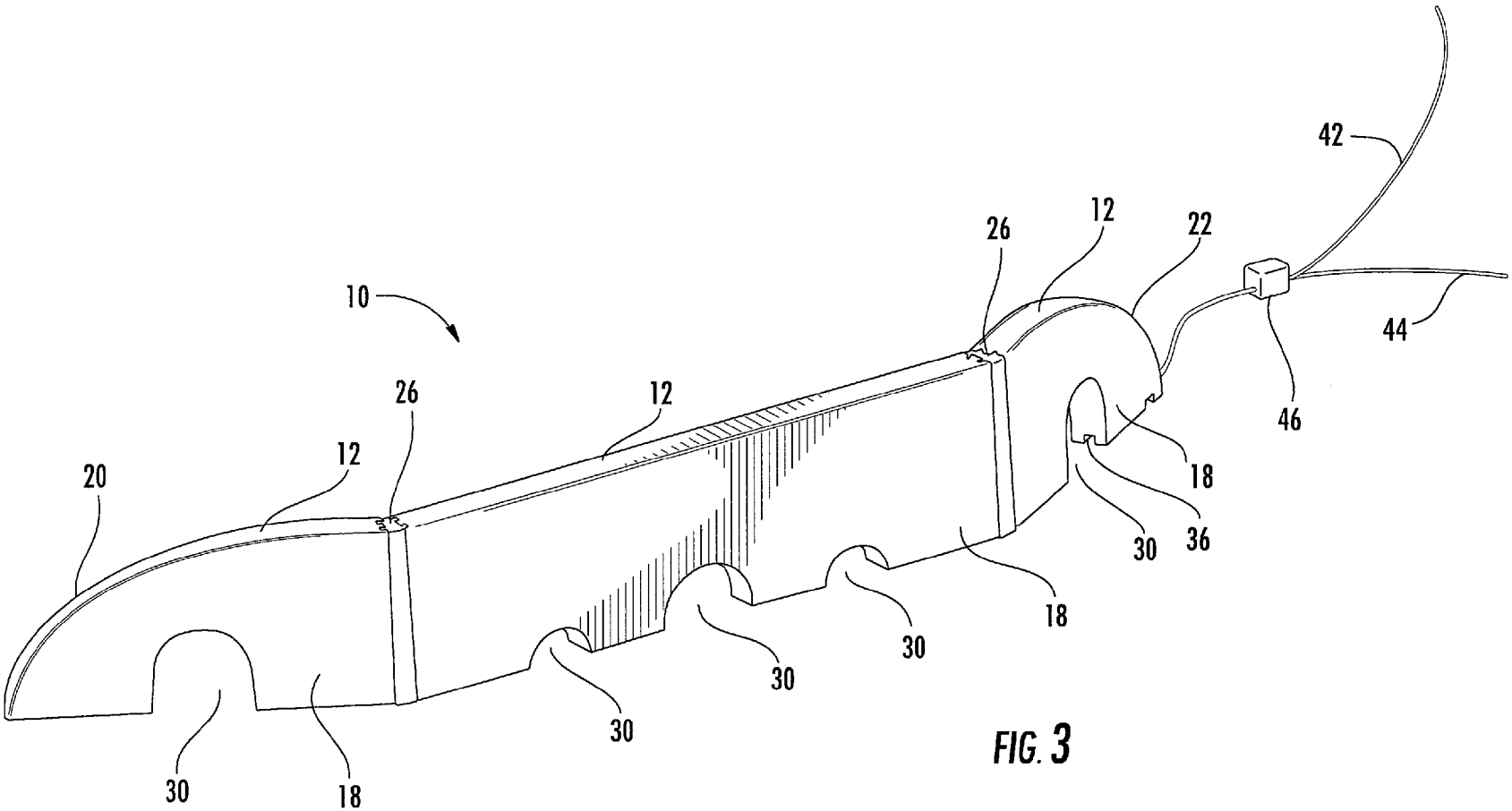
FIG. 3 is a rear view of a preferred embodiment of the game apparatus.
Figure 4:
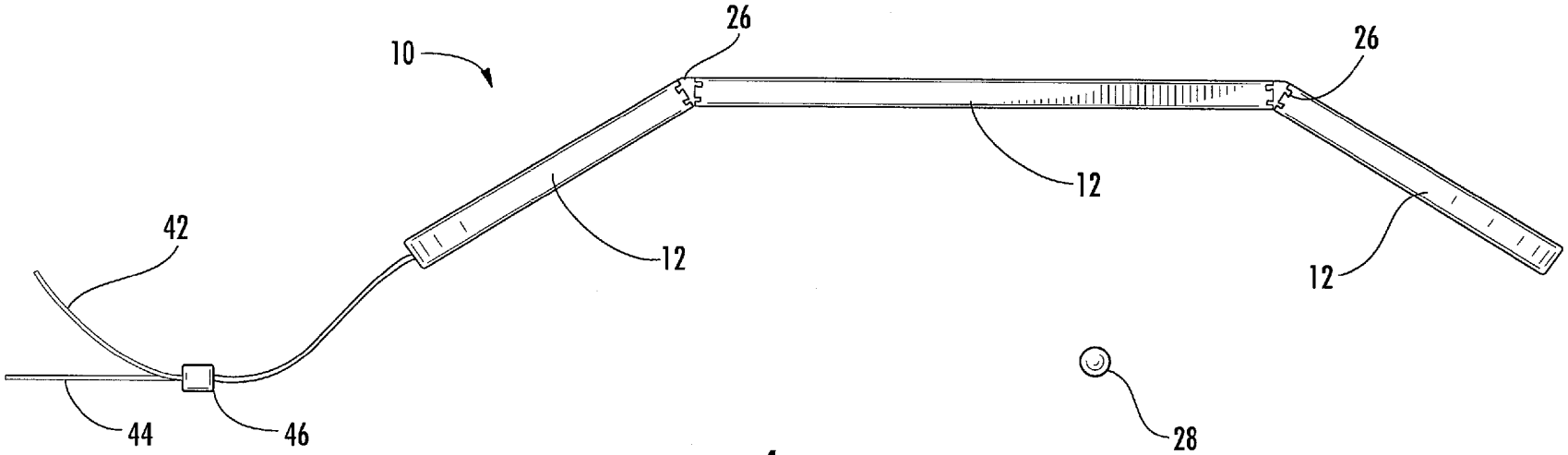
FIG. 4 is an overhead view of a preferred embodiment of the game apparatus.

FIGS. 1-4 illustrate a preferred embodiment of the game apparatus. In the illustrated embodiment, the game apparatus 10 preferably includes a plurality of walls 12. The plurality of walls includes a main wall and first and second support walls. Each wall 12 of the game apparatus 10 is defined by a base 14, a front face 16, a rear face 18, a first end 20, and a second end 22. The game apparatus 10 preferably further includes a plurality of connectors 26, for example, a hinge. Each connector 26 is preferably adapted to mate with the first end 20 of a main wall 12 and the second end 22 of a support wall 12. In a preferred embodiment of the game apparatus, the connector 26 are preferably adapted to mate in a manner that permits the front faces 16 of adjacent walls to rest in a position that is less than or more than 180 degrees from one another for support of the main wall.

It will be understood by one with ordinary skill in the art that the game apparatus may further comprise a plurality of fasteners, such as screws, adapted to secure a connector 26 to one or more walls 12 of the game apparatus 10.

It will be understood by one with ordinary skill in the art that one purpose of the above-described embodiment of the game apparatus 10 is to permit the game apparatus 10 to rest on a relatively flat surface. In other embodiments (not shown) the game apparatus (which game apparatus may comprise a single wall or multiple walls) may include one or more stands, which may be integrally attached to the game apparatus and/or may comprise separate structures designed to mate with, attach to, and/or adhere to the game apparatus, or some portion thereof, to permit the game apparatus to rest upright, such that the front face of one or more walls of the game apparatus is approximately perpendicular to the supporting surface. In still other embodiments (not shown), the base of one or more walls may be sufficiently wide to permit the game apparatus to rest on a relatively flat surface. In the alternative, or in addition, the base may be comprised of one or more components and/or materials that can be bent, adjusted, or otherwise manipulated to permit the game apparatus to rest on a relatively flat surface.

The game apparatus 10 may further comprise a ball 28, such as a golf ball, and/or may comprise instructions (not shown), written, graphic, or otherwise, that describe one or more types of balls, such as a golf ball, preferred for use with the game apparatus 10 to play a game. It will be understood by one with ordinary skill in the art that many types of balls, including tennis balls, hockey pucks, etc., could be used in connection with the game apparatus to play a game.

The game apparatus 10 may further comprise a means for propelling a ball, such as a putter (not shown), and/or may comprise instructions (not shown), written, graphic or otherwise, that describe a means of propelling a ball, such as a putter, preferred for use of the game apparatus to play a game.

As shown in FIGS. 1-4, one or more walls 12 of the game apparatus 10 include a plurality of openings 30. In some preferred embodiments of the game apparatus 10, the openings 30 may vary in size. The openings 30 may also vary in shape (such as circular, oval, or square). In other preferred embodiments of the game apparatus 10, the openings 30 may be substantially equal in size and/or substantially similar in shape. One or more openings 30 are of sufficient size and shape to accommodate a preferred game ball 28.

In the preferred embodiment of the game apparatus 10, game graphics 32 associated with one or more openings 30 are provided on the front face 16 and/or the rear face 18 of one or more walls 12 of the game apparatus 10. Said game graphics may be assigned values based upon one or more games.

For example, game graphics may associate playing card values of an ace with a first opening, a king with a second opening, a queen with a third opening, a jack with a fourth opening, and a ten with a fifth opening.

It will be understood by one with ordinary skill in the art that other game graphics associated with one or more openings could be provided on the front face 16 and/or the rear face 18 of one or more walls 12 of the game apparatus 10. For example, game graphics may be letters that can be combined to spell words. In another example, game graphics may represent the sides of a die.

The game graphics 32 associated with one or more openings 30 in a wall 12 the game apparatus 10 can be permanently affixed to such wall 12, or the game graphics may be provided by a plurality of indicators (not shown) adapted to removably adhere, connect or otherwise attach to such walls 12, such that selective placement of an indicator on or near an opening 30, will permit association of the game graphics of such indicator with such opening 30 when the game apparatus 10 is used to play a game. Also selectively adjustable electrical indicators such as LED's or LCD's or other electrical or electromechanical display indicators may be used to display a variety of values or graphics input by the user or selected from an array of pre-set values or graphics.

In the preferred embodiment of the game apparatus 10, a plurality of opening sensors 36 and a plurality of proximity sensors 40 are affixed to, integrally included within, and/or otherwise associated with the game apparatus 10. Preferably, one or more opening sensors 36 are associated with each opening 30 and operate to detect an object, for example, a ball, resting in and/or passing into or through the opening 30. Such opening sensors indicate a successful attempt to pass the ball into or through the opening.

One or more proximity sensors 40 preferably operate to detect the presence of an object, for example, a ball, that rests and/or moves within a given distance of the game apparatus 10 and can be used to indicate an attempt (successful or unsuccessful) to pass the ball into or through one of the openings 30. It will be further understood by one with ordinary skill in the art that many types of sensors are known and available that operate to generate a signal upon detecting the presence and/or movement of an object, and that any such sensor, whether now known or subsequently developed, including but not limited to, any such sensor that is electrical, mechanical, laser, sonic and/or optical in nature, could be used as a part of the game apparatus 10.

The opening sensors 36 and proximity sensors 40 are preferably linked to a processor (not shown) which is adapted to associate the detection signal from an opening sensor 36 with the value assigned to such opening 30, as depicted in the game graphics associated with such opening 30. Such processor is preferably further adapted to associate the detection signal from a proximity sensor 40 without an associated detection signal from any of the opening sensors 36 as an unsuccessful attempt, which is attributed a value of zero. It will be understood by one with ordinary skill in the art that the processor will preferably be adapted to manipulate values (or absence of value) assigned based on the above-described detection signals generated by the opening sensors 36 and/or proximity sensors 40 to play a game of strategy and/or chance, including a pre-existing game, such as a card game.

For example, as illustrated in FIG. 1, the front face 16 and/or the rear face 18 of one or more walls 12 includes game graphics 32 associating playing card values with each opening 30. The processor may be adapted to associate the values, i.e., cards, of a player, detected in each of a pre-determined number of turns (where a turn may be a player's effort to propel an object through an opening 30, preferably associated with a value, in the manner described above), for example, five turns, each with a value based on playing cards as used in a pre-existing card game, such as five-card stud poker.

The processor may then compute values for each player, based upon the five card values associated with each player's "hand" to determine a score for each player. For example, if the five cards in one player's "hand" were a 10, jack, queen, king and ace, all of the same suit, a score of 500 points may be awarded to the player for achieving a royal straight flush. By comparison, another player who collected the five "hand" values of 10, 10, jack, jack, queen, may be awarded a score of 100 points for achieving two pairs.

It will be understood by one with ordinary skill in the art that many processors are known and available to perform the functions described herein and/or otherwise desirable in connection with the game apparatus 10 and use of the game apparatus 10 to play a game, including a pre-existing game, and that any such processor, such as a PC or other programmable device, whether now known or subsequently developed, could be used as a part of the game apparatus 10. In addition, many methods are known in the art by which the opening sensors 36 and the proximity sensors 40 can be linked to the processor and include, but are not limited to, wired electrical connections, fiber optic systems, wireless systems, audio systems, infrared and/or optical systems.

The preferred embodiment of the game apparatus 10, may further comprise an input device, and/or may comprise instructions, written, graphic or otherwise, that describe an input device preferred for use of the game apparatus 10 to play a game. In such embodiment, the processor is adapted to receive a plurality of inputs from the players, such as the number of players and the type of game to be played. For example, in a preferred embodiment of the game apparatus 10 in which the front face 16 and/or the rear face 18 includes game graphics associating a playing card value with each opening 30, the input device may include a mechanism by which a player may choose to use the game apparatus 10 to play a selected one of a plurality of pre-existing card games. The processor may be adapted to receive other inputs via an input device which are known in the art and include, but are not limited to, inputs to signal the start of a game, to pause a game, to start a new game, to add a player, to delete a player, to skip a player, to enter the name of a player, to modify a score, and/or to enter a score.

Many input devices are known in the art and include, but are not limited to, a keypad, keyboard, touch screen, voice recognition, mouse, and/or joystick. Many methods are known in the art by which an input device can be linked to a processor and by which a processor can be adapted to receive input from an input device and include, but are not limited to, wired electrical connections, fiber optic systems, wireless systems, audio systems, infrared and/or optical systems.

In the preferred embodiment of the game apparatus 10, such game apparatus 10 further comprises a display device, and/or may comprise instructions, written, graphic or otherwise, that describe a display device preferred for use of the game apparatus 10 to play a game. The display device and the input device may be combined into a single unit 48 or may be separate units. In such embodiment, the processor is adapted to cause the display device to display graphics and/or produce audio sounds associated with use of the game apparatus 10 to play a game, which graphics and/or audio sounds may include, but are not limited to, scores, number of players, names of players, a high score, historical scores, number of remaining turns in play of the game, and/or the method of play in use. Many display devices capable of displaying graphics and/or producing audio sounds are known in the art and include, but are not limited to, a television, a computer monitor, a receiver, a voice synthesizer, a video display device, a mechanical display device, and an audio device. Many methods are known in the art by which such display device can be linked to a processor and include, but are not limited to, wired electrical connections 42, fiber optic systems, wireless systems, mechanical systems, audio systems, infrared and/or optical systems.

In a preferred embodiment of the game apparatus 10, such game apparatus 10 further comprises a power source and/or a means of connection to a power source, by which power is provided to operate the opening sensors, the proximity sensors, the processor, the input device and/or the display device. Such power sources and means of connection to a power source are known in the art and include electrical cables 44, batteries, and/or light (or solar) panels. It will be understood, however, that opening sensors, proximity sensors, input devices and display devices are available and known in the art that operate mechanically and that an embodiment of the game apparatus 10 in which mechanical opening sensors, proximity sensors, input devices and/or display devices are used may not need nor comprise a power source or means of connection to a power source.

It will be understood by one with ordinary skill in the art that any one or more of the opening sensors, the proximity sensors, the processor, the input device, the display device, the power source, and/or the means of connection to a power source may be combined in a single unit and/or exist as separate units. It will be further understood that any one or more of the opening sensors, the proximity sensors, the processor, the input device, the display device, the power source, and/or the means of connection to a power source may be attached to and/or integrally included within a wall and/or connector of the game apparatus and/or may exist as units separate from a wall and/or connector of the game apparatus. In a preferred embodiment of the game apparatus 10, the game apparatus 10 further comprises an electrical cable adapted to connect to a power source 44, a transformer and line splitter 46, and an electrical connection adapted to connect to a display device.

What is claimed is:

1. A golf game apparatus for use with a golf ball comprising:

a main wall defined by a front face spaced apart from a rear face by a width, opposing sidewalls, and a base surface, said base surface adapted to support said main wall on a remote surface, said base surface is parallel to said remote surface;

a first and second support wall, each said support wall defined by a front surface, a rear surface, opposing endwalls, and a base; wherein one said endwall on said first support wall is constructed and arranged to mate with one said sidewall on said main wall and one said endwall on said second support wall is constructed and arranged to mate with said opposing sidewall on said main wall;

at least one opening along said base surface of said main wall, said opening extending from said front face to said rear face of said main wall, and at least one opening along said base of each said support wall, said opening extending from said front surface to said rear surface of each said support wall, each said opening constructed and arranged to permit the entry of a golf ball through each said opening;

at least one opening sensor, each said opening sensor being mounted in each said opening, each said opening sensor capable of generating a first signal upon detecting said golf ball passing into said opening;

at least one proximity sensor mounted on said front face of said main wall and at least one proximity sensor mounted on said front surface of each said support wall, each said proximity sensor generates a second signal upon detecting said golf ball within proximity to said main wall and said support walls;

at least one graphic element on said front face of said main wall and said front surface of each said support wall, whereby each graphic element corresponds to each said opening, each said graphic element displays a value associated with each said signal;

a processor in communication with said at least one proximity sensor, said at least one opening sensors, and said at least one graphic element; wherein said processor is adapted to interpret said first signal from said opening sensor with a first value associated with said opening and display said first value on said graphic element, and said processor is further adapted to interpret said second signal from said proximity sensor in the absence of said first signal from said opening sensor with a second value associated therewith and display said second value on said graphic element; and a power source electrically connected to said processor.

2. The golf game apparatus for use with a golf ball of claim 1, wherein said processor is further adapted to interpret said second signal from said at least one proximity sensor in the absence of said first signal from said opening sensor, wherein said graphic element displays said second value, and said second value is zero in the absence of said first signal.

3. The game apparatus of claim 1, further comprising an input device linked to said processor, said input device assigns various said first and second values to each said first and second signal, respectively.

4. The golf game apparatus for use with a golf ball of claim 1, wherein said sidewalls on said main wall include a pair of connector hinges, each said connector hinge adapted to mate with one said endwall on said first support wall and said second support wall to support said main wall.

* * * * *